US006045019A

United States Patent [19]

Moses

[11] Patent Number: 6,045,019

[45] Date of Patent: Apr. 4, 2000

[54] STRAP FOR CARRYING SHOPPING BAGS BY HAND OR ON SHOULDER

[75] Inventor: Allen R Moses, Brooklyn, N.Y.

[73] Assignee: Strapper Inc., Brooklyn, N.Y.

[21] Appl. No.: 08/991,381

[22] Filed: Dec. 16, 1997

Related U.S. Application Data

[60] Provisional application No. 60/033,515, Dec. 17, 1996.

[51] Int. Cl.[7] ..... A45F 3/14

[52] U.S. Cl. ..... 224/257; 294/170

[58] Field of Search ..... 224/577, 581, 224/582, 583, 201, 257, 260, 264, 265, 268, 269, 925; 383/6, 13, 70; 294/170, 171, 141–143, 146, 149, 153, 156, 158, 159; 16/112, 122, 124; 220/755, 750, 752

[56] References Cited

U.S. PATENT DOCUMENTS

| | | | |
|---|---|---|---|
| 3,251,622 | 5/1966 | Miller | 294/170 |
| 4,483,470 | 11/1984 | Cousins | 224/257 |
| 4,763,833 | 8/1988 | Stoll | 229/117.12 |
| 4,867,359 | 9/1989 | Donovan | 224/257 |
| 4,991,894 | 2/1991 | Rutens | 294/170 |
| 5,110,023 | 5/1992 | Colin | 224/205 |
| 5,181,757 | 1/1993 | Montoya | 294/159 |
| 5,292,044 | 3/1994 | Reimers | 224/264 |
| 5,419,475 | 5/1995 | Naritomi | 224/257 |
| 5,509,708 | 4/1996 | Nathan | 294/141 |
| 5,599,052 | 2/1997 | Van Davelaar | 294/159 |
| 5,667,266 | 9/1997 | Giocanti | 294/170 |

*Primary Examiner*—Allan N. Shoap
*Assistant Examiner*—Maerena W. Brevard

[57] ABSTRACT

A strap includes an elongate sheet of material with two end portions and a central portion. Each of the end portions is provided with a pair of lateral hooks dimensioned and configured to receive the plastic handles of a shopping bag or the like. The strap may be made from corrugated hollow core material, in which case it may be die cut, or it may be solid plastic injection molded. The strap may be uniform thickness or may be selectively reduced in thickness to save material and weight in those regions where the extra material is not essential to the integrity of the strap. Advantageously, the central portion is provided with one flat surface suitable for use on the shoulder and one contoured surface to conform to the shape of the hand and fingers to maximize comfort when the strap is carried by hand. Indicia, in the form of a brand name, or advertising may be either molded into the solid plastic strap or may be directly imprinted on the strap or on a separate media which can be attached to the central portion.

20 Claims, 3 Drawing Sheets

22
10A
W
A
10A
M
30
28
N 10B
36
L
10B

P
32
34

Q 10C
40
38

N 100
40

10E
42
12
RB
FB

STRAP FOR CARRYING SHOPPING BAGS BY HAND OR ON SHOULDER

CROSS REFERENCE TO RELATED APPLICATION

This application claims priority of Provisional Application No. 60/033515 filed Dec. 17, 1996.

BACKGROUND OF THE INVENTION

1. Field of the Invention

This invention generally relates to carrying devices and, more specifically, to a strap for facilitating carrying shopping bags by hand or on a shoulder.

2. Description of the Prior Art

Paper bags commonly used in food shops and supermarkets have been supplanted in most of these establishments with plastic bags provided with opposing openings which form hand gripping portions or handles. However, while almost universally used, such plastic bags tend to have substantially smaller capacity than the paper variety and any significant purchase invariably results in multiple such bags being packed. Also, when heavy items, such as cans or bottles, are packed the handles gather and stretch to form relatively thin bands which apply substantial forces concentrated along narrow areas or regions of the hand, which can be painful when the bags are carried over for any period of time or distance.

While shoulder straps have been used to carry numerous items, such as cameras, pocketbooks, luggage and the like, shoulder straps have not been used to carry disposable plastic bags of the type used by supermarkets to package food products.

SUMMARY OF THE INVENTION

It is an object of the invention to provide a strap for facilitating carrying shopping bags by hand or on a shoulder.

It is another object of the invention to provide a strap as in the previous object which is simple in construction and economical to manufacture.

It is still another object of the invention to facilitate carrying of multiple filled plastic shopping bags with minimum effort and maximum comfort.

It is yet another object of the invention to allow the carrying of plastic shopping bags to free the hands of the user.

It is a further object to provide a strap of the type above suggested which can be used to carry plastic shopping bags, or the like, either by hand or across a shoulder while distributing the forces of the weight to minimize the discomfort or pain typically encountered when carrying such bags directly by hand.

It is yet a further object of the invention to provide a strap of the type under discussion which prevents or minimizes slippage when it is supported on the shoulder.

In order to achieve the above objects, as well as others which will become evident to those skilled in the art, a strap for carrying shopping bags or the like by hand or across a shoulder is made of a relatively thin elongate sheet of material which defines a longitudinal axis and which is flexible at least along its length direction or axis. A central portion is dimensioned and configured to be gripped by the hand or rest on a human shoulder and extend to each side thereof. An end portion is provided at each end of the central portion and formed with gripping means for engaging and retaining the handle formed in a a plastic shopping bag. In one form, the gripping portions comprise opposed hook-like lateral openings or cutouts on each end portion which receive the shopping bag handles but resist their removal when supported bags on said end portions are pulled in opposite directions. Preferably, at least one surface of the central portion which rests on the shoulder is provided with an anti-slipping material to better secure the strap on the shoulder while the other or opposing surface is rounded or profiled to conform to the hand and fingers.

DESCRIPTION OF THE PREFERRED EMBODIMENTS

Figure 1:
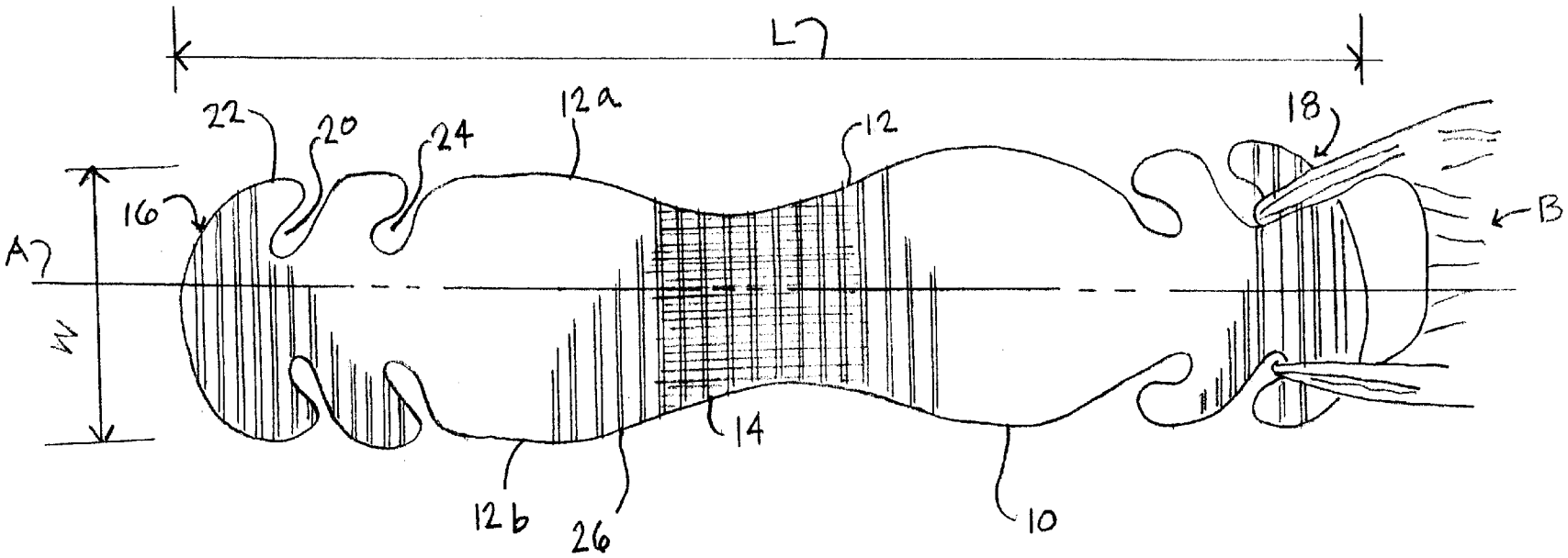
FIG. 1 is a top plan view of a strap in accordance with the invention, illustrating the manner in which a handle of a plastic shopping bag is received and retained within one of the end gripping portions.

In FIG. 1 one embodiment of the strap in accordance with the invention is designated by the reference numeral 10. The strap 10 is generally elongate and defines a longitudinal axis A. In the preferred embodiment shown the axis A is also an axis of symmetry, although it will become evident to those skilled in the art that the strap need not have mirror image symmetry about the axis A. The strap 10 may be formed of thin sheet material. Although various materials may be used, as to be described, the material used should be flexible at least along the length direction or in the direction of the axis A. Polyethylene may be used for the straps, although other plastics or other suitable materials may also be used, with different degrees of advantage.

Figure 2:
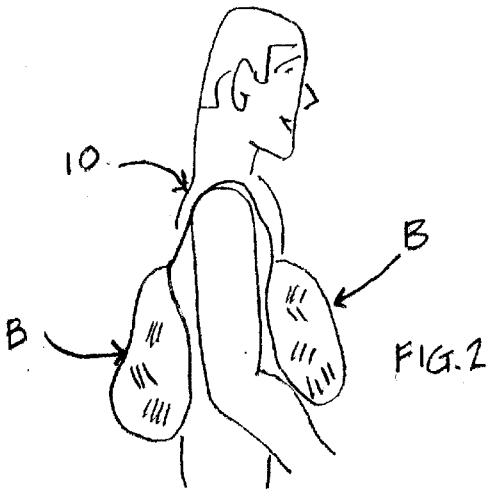
FIG. 2 illustrates the manner in which the strap of the invention is typically used to carry two plastic shopping bags.

The strap 10 includes a central portion 12 having lateral edges 12*a*, 12*b* and which is dimensioned and configured to be gripped by the hand or to rest on a human shoulder and extend to each side thereof. This is illustrated in FIG. 2, in which the strap 10 is shown as it would normally be used to support at least two bags B on a shoulder. It will be noted that the strap 10 conforms, under the weight of the bags, to the shape of the shoulder. The axial length of the strap 10 is not critical although the length should be selected to position the bags being carried at a comfortable height at the front and rear of the user. It has been found, for example, that an overall length L equal of about 13" is suitable, although different lengths may be used to accommodate the size and/or height of the user. The central portion may be ergonomically shaped to maximize comfort and minimize high stress concentrations on the shoulder, such as providing constrictions 14.

Preferably, the central portion 12 is provided on the surface thereof which is intended to rest on the shoulder, with anti-slipping means to better secure the strap on the shoulder, and prevent the strap from slipping on the shoulder during use.

In the broadest aspects of the invention the central portion is provided at each axial end thereof with gripping means for engaging and retaining a handle formed in a plastic shopping bag. Such gripping means can take any form which will suitably and selectively grip a shopping bag and retain it. Therefore, such gripping means may include clips or the like. However, in the presently preferred embodiments, such gripping means are in the form of transversely or laterally spaced hook-like lateral openings or cutouts, on opposite sides of the axis A, at each end portion 16,18, which receive the shopping bag handles but resist their removal when supported bags on said end portions are pulled in opposite directions, as suggested in FIG. 2.

In FIG. 1, each of the end portions 16, 18 is provided with a first, outer gripping portion in the nature of hook-like opposed lateral openings or cutouts 20 which form hook-like closure members 22. The associated cutouts or openings 20 are symmetrically arranged in relation to the axis A, although they may be at least slightly axially offset from each other. Second, inner gripping portions 24 are provided spaced inwardly from an associate first gripping portion as shown. The number of gripping portions is not critical and can be selected based on the desired carrying capacity, each gripping portion accommodating another bag, and will also be a function on the tensile strength of the strap since the more bags that are carried, the higher the tensile stresses that the strap must withstand. The longitudinally spaced gripping portions may also be used to adjust the bags at a comfortable height when they are carried.

The strap 10 of FIG. 1 is provided with longitudinal cuts 26 to enhance the friction in the lateral direction normal to the axis A, to reduce slippage off the shoulder during use.

Figures 3, 4, 5, 6, 7, 8, 9, 10, 11, 12, 13:
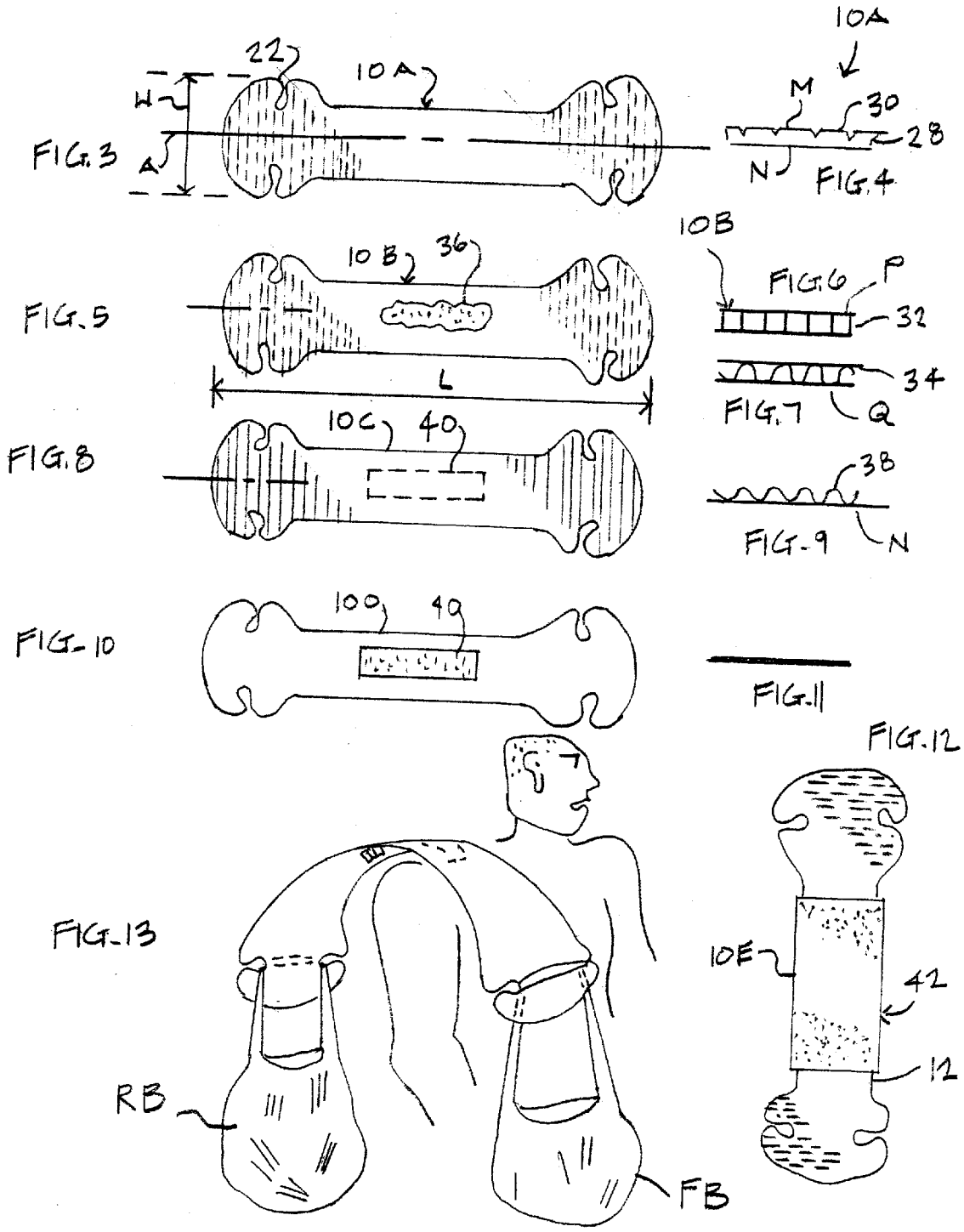
FIG. 3 is similar to FIG. 1 but showing an another embodiment of the invention.
FIG. 4 is a cross-section of a solid material from which the strap of FIG. 1 is formed.
FIG. 5 is similar to FIG. 3 but showing still another embodiment of the invention.
FIG. 6 is a cross-section of a double clad honey-comb material from which the strap of FIG. 5 may be formed.
FIG. 7 is a cross-section of a double clad corrugated material that may be used to form the strap of FIG. 5.
FIG. 8 is similar to FIG. 5 but showing yet another embodiment of the invention.
FIG. 9 is a cross-section of a single clad corrugated material from which the strap of FIG. 8 may be formed.
FIG. 10 is similar to FIG. 8 but showing a further embodiment of the invention.
FIG. 11 is a cross-section of a thin sheet of stock material from which the strap of FIG. 10 may be formed.
FIG. 12 is similar to FIG. 10 but showing a yet further embodiment of the invention.
FIG. 13 illustrates the principle of operation in the use of the strap of the invention.

The embodiment 10A in FIG. 3 includes only one set of gripping portions 22 at each axial end 22. The strap 10A is formed of a solid sheet 28 of flexible material having surfaces M and N. The surface M is formed with cuts or grooves 30 for reducing slippage. The embodiment 10B shown in FIG. 5 is similar to the one shown in FIG. 3. However, the strap 10B is formed of profile sheet material, as suggested in FIGS. 6 and 7. In FIG. 6 the sheet is in the nature of a honeycomb hollow core 32 double clad with two smooth sheets P, Q of material. In FIG. 7 the sheet is in the nature of an undulating corrugated hollow core 34 double clad with two sheets of material. In each case the thickness of the core and cladding sheets must be sufficiently flexible to allow at least limited bending as shown in FIG. 2. Also in FIG. 5 the surface intended to rest on the shoulder is at least partially coated with a suitable tacky substance 36 which prevents slippage on the shoulder.

The strap 10C of FIG. 8 is similar to the strap 10 shown in FIG. 1, except that it has only one set of gripping portions at each axial end as do the straps 10A and 10B. The strap 10C, like the strap 10A, is formed of a single clad corrugated hollow core 38. Any conventional or known anti-slide material 40 may be attached on the surface N in FIG. 9. One such material may be a strip of Velcro® sewn onto the central portion 12.

The strap 10D shown in FIGS. 10 and 11 is formed of a thin sheet of plastic material, likewise provided with a suitable strip 40 of non-slip material.

In FIG. 12, the strap 10E is shown with a sleeve 42 which surrounds the central portion 12. The sleeve 42 may be formed of any flexible material, such as paper, plastic, or the like, which can cover possibly sharp edges of the central portion and prevent injury, such as cuts, when a user's hand grasps the central portion while carrying heavy bags supported on the gripping portions. Preferably, the sleeve 42 is also suitable for printing or is pre-printed with instructions, company name or logo or advertisements.

Rear and front shopping bags RB and FB, respectively, are shown in FIG. 13 supported by the straps of the invention during normal use.

Figures 14, 15, 16:
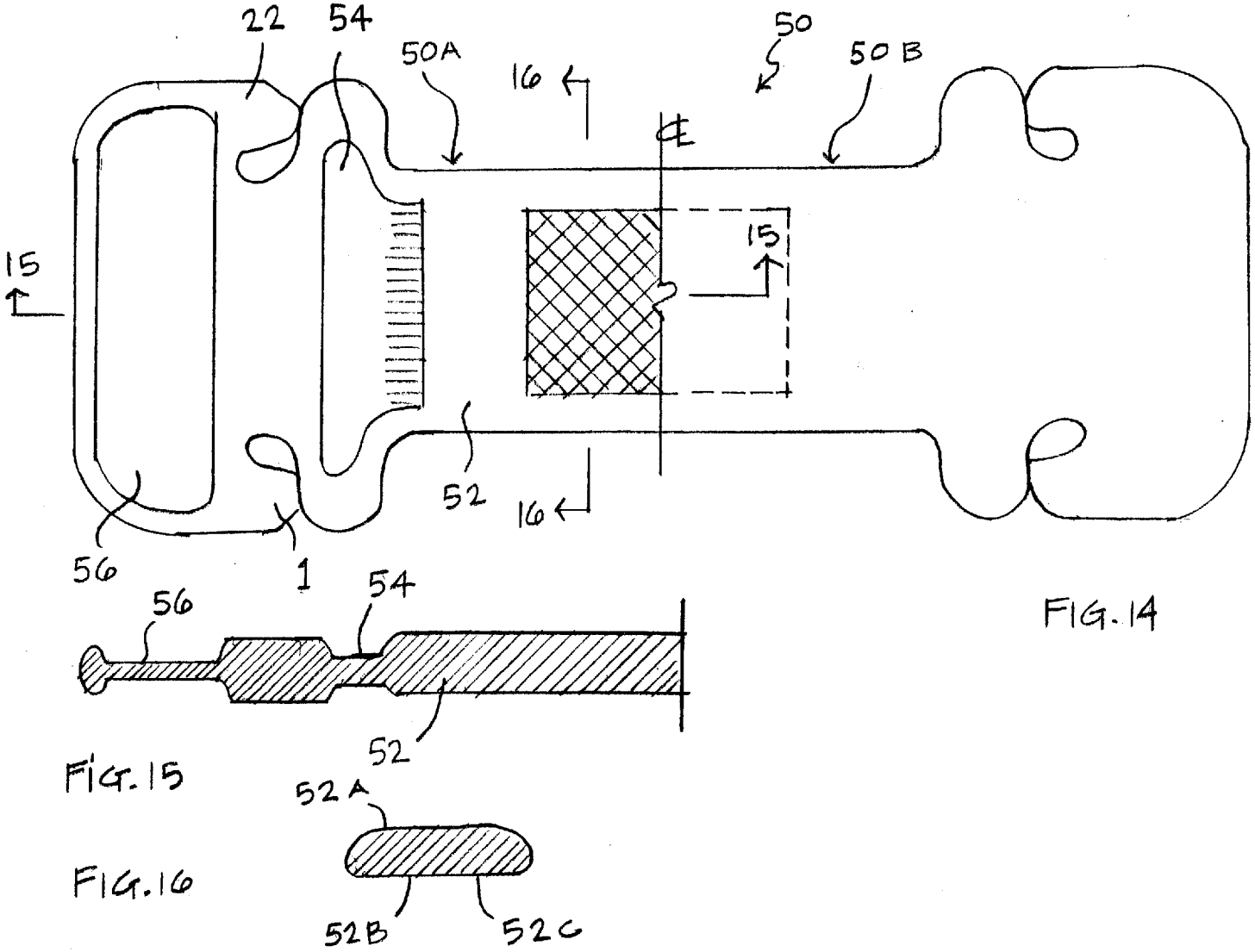
FIG. 14 is similar to FIG. 1 but shows a further embodiment of the invention, in which the strap is molded of a solid plastic material, showing two possible variations—on the right side, where the thickness of the strap is substantially uniform along its length and, on the left side, where selected portions of the strap are of reduced thickness to save material and weight.
FIG. 15 is a cross-sectional view of the strap shown in FIG. 14, taken along line 15—15.
FIG. 16 is a cross-sectional view of the strap shown in FIG. 14, taken along line 16—16.

A modified strap design 50 is shown in FIG. 14 that may be injection molded of a plastic material. Two variations are illustrated. To the right of the centerline, the strap portion 50B has a cross section that is substantially uniform. The strap portion 50A to the left of the center line has selected portions 54,56 removed to conserve material and weight. The center portion 52 is essentially the same for both variations and shown in FIG. 15 to be substantially uniform in thickness. As best shown in FIG. 16, one side 52A is curved to be more comfortable for gripping by the hand by eliminating sharp edges. The reverse side 52B may be flat for use on a shoulder, this surface preferably being provided with any form of anti-slipping means 52C, such as a tacky substance, a textured surface, or the like. The surface 52B may also be contoured or otherwise made to conform to the shape of the hand and fingers to maximize comfort and ease of use.

It is to be understood that the present invention is not limited to the embodiments described above, but encompasses any and all embodiments within the scope of the following claims.

I claim:

1. Strap for carrying at least two shopping bags by hand or across a shoulder comprises a relatively thin sheet of elongate material which defines a longitudinal axis in the flat condition of said elongate sheet of material including a central portion, dimensioned and configured to be gripped by the hand of a user or to rest on a human shoulder, an end portion at each longitudinal or axial end of said central portion and having lateral edges spaced from said axis; and a pair of spaced engaging members proximate to and along said lateral edges of each end portion for simultaneously engaging a handle of a pliable shopping bag by extending between said engaging members and transversely across at least a part of an associated end portion, whereby supporting the handles of weighted shopping bags on each end portion places each end portion under compression in a direction substantially normal to said axis and draws those portions of the shopping bag handles substantially parallel to said axis inwardly towards said axis and facilitate the carrying of the shopping bags with comfort while enhancing the strength of the strap for a predetermined thickness of said sheet of elongate material.

2. Strap as defined in claim 1, wherein said sheet material comprises hollow core corrugated plastic sheet material.

3. Strap as defined in claim 2, wherein the material is double faced.

4. Strap as defined in claim 2, wherein the material is single faced.

5. Strap as defined in claim 2, wherein the corrugations extend transversely to said longitudinal axis.

6. Strap as defined in claim 1, wherein said sheet material comprises solid plastic molded material.

7. Strap as defined in claim 1, wherein said central portion is substantially flat on one side thereof suitable for placing across a shoulder.

8. Strap as defined in claim 1, wherein said central portion is provided with a curved surface on one side thereof suitable for being gripped by a hand.

9. Strap as defined in claim 8, wherein said curved surface is contoured to conform to the shape of the hand and the fingers.

10. Strap as defined in claim 7, wherein said flat surface is provided with a tacky substance to prevent slipping when supported on a shoulder.

11. Strap as defined in claim 7, wherein said flat surface comprises a textured surface to prevent slipping when supported on a shoulder.

12. Strap as defined in claim 1, wherein said flat surface is provided with visible and readable indicia.

13. Strap as defined in claim 12, wherein said indicia is formed in the material.

14. Strap as defined in claim 13, wherein said indicia comprises characters and/or designs raised above the surface of said central portion.

15. Strap as defined in claim 13, wherein said indicia comprises characters and/or designs recessed below the surface of said central portion.

16. Strap as defined in claim 13, wherein said indicia comprises a band of material imprinted with printed matter and wrapped about said central portion.

17. Strap as defined in claim 1, wherein said gripping means comprises one pair of laterally or transversely spaced hooks on opposite sides of said axis.

18. Strap as defined in claim 17, wherein each hook is formed by a hole in said sheet material between said axis and a lateral edge and an access opening extending between said hole and an associated lateral edge.

19. Strap as defined in claim 18, wherein said access opening is provided in the proximity of the lateral region of said sheet of elongated material.

20. Strap as defined in claim 18, wherein said access opening is substantially closed and provides minimal clearance for the handles of the plastic bags, whereby forced insertion of the handles of the plastic bags through said access openings into said hooks minimizes the risk of the handles from inadvertently separating from the strap.

* * * * *